US005994694A

United States Patent [19]

Frank et al.

[11] Patent Number: 5,994,694

[45] Date of Patent: Nov. 30, 1999

[54] ULTRA-HIGH-MASS MASS SPECTROMETRY WITH CHARGE DISCRIMINATION USING CRYOGENIC DETECTORS

[75] Inventors: Matthias Frank, Berkeley; Carl A. Mears, Oakland; Simon E. Labov, Berkeley; W. Henry Benner, Danville, all of Calif.

[73] Assignee: The Regents of the University of California, Oakland, Calif.

[21] Appl. No.: 08/984,921

[22] Filed: Dec. 4, 1997

Related U.S. Application Data

[60] Provisional application No. 60/032,527, Dec. 6, 1996.

[51] Int. Cl.[6] ..... H01J 49/40

[52] U.S. Cl. ..... 250/281; 250/287; 250/397

[58] Field of Search ..... 250/281, 288, 250/287, 305, 309, 397

[56] References Cited

U.S. PATENT DOCUMENTS 5,640,010 6/1997 Twerenbold ..... 250/281

FOREIGN PATENT DOCUMENTS

91/06016 5/1991 WIPO .
96/04676 2/1996 WIPO .

OTHER PUBLICATIONS

D. Twerenbold et al., "Detection of Single Macromolecules Using a Cryogenic Particle Detector Coupled To A Biopolymer Mass Spectrometer," Applied Physics Letters, 68 (1996) 3503.

D. Twerenbold, "Biopolymer Mass Spectrometer With Cryogenic Particle Detectors," Nuclear Instruments and Methods, Physics Research, A 370, (1996) 253–255.

D. Twerenbold, "Cryogenic Particle Detectors," Rep. Progr., Part. Phys. 59 (1996) 349–426.

M. Frank et al., "High–Efficiency Detection of 66 000 Da Protein Molecules Using A Cryogenic Detector In A Matrix Assisted Laser Desorption/Ionization Time–Of Flight Mass Spectrometer," Rapid Communications In Mass Spectrometry, vol. 10, 1946–1950 (1996).

M. Frank et al., "High–Efficiency Detection of 66 000 Da Protein Molecules Using A Cryogenic Detector In A Matrix–Assisted Laser Desorption/Ionization Time–Of Flight Mass Spectrometer," Rapid Communications In Mass Spectrometry, vol. 10, 1946–1950 (1996).

W. Henry Benner et al., "Simultaneous Measurement of Flight Time . . . ," American Society for Mass Spectrometry, 1997 pp. 1094–1102.

*Primary Examiner*—Edward P. Westin
*Assistant Examiner*—Nikita Wells
*Attorney, Agent, or Firm*—L. E. Carnahan

[57] ABSTRACT

An ultra-high-mass time-of-flight mass spectrometer using a cryogenic particle detector as an ion detector with charge discriminating capabilities. Cryogenic detectors have the potential for significantly improving the performance and sensitivity of time-of-flight mass spectrometers, and compared to ion multipliers they exhibit superior sensitivity for high-mass, slow-moving macromolecular ions and can be used as "stop" detectors in time-of-flight applications. In addition, their energy resolving capability can be used to measure the charge state of the ions. Charge discrimination is very valuable in all time-of-flight mass spectrometers. Using a cryogenically-cooled Nb-$Al_2O_3$-Nb superconductor-insulator-superconductor (SIS) tunnel junction (STJ) detector operating at 1.3 K as an ion detector in a time-of-flight mass spectrometer for large biomolecules it was found that the STJ detector has charge discrimination capabilities. Since the cryogenic STJ detector responds to ion energy and does not rely on secondary electron production, as in the conventionally used microchannel plate (MCP) detectors, the cryogenic detector therefore detects large molecular ions with a velocity-independent efficiency approaching 100%.

20 Claims, 2 Drawing Sheets

ULTRA-HIGH-MASS MASS SPECTROMETRY WITH CHARGE DISCRIMINATION USING CRYOGENIC DETECTORS

RELATED APPLICATION

This application relates to U.S. Provisional application No. 60/032,527 filed Dec. 6, 1996, and claims priority thereof.

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to time-of-flight mass spectrometry, particularly to cryogenic particle detectors as ion detectors with charge discriminating capabilities in high-mass time-of-flight mass spectrometers, and more particularly to a cryogenically-cooled Nb-$Al_2O_3$-Nb superconductor-insulator-superconductor tunnel junction (STJ) detector which enables near 100% detection efficiency for all ions including single, very massive, slow moving macromolecules.

Time-of-flight mass spectrometry (TOF-MS) is a fast, inexpensive and efficient technique for characterizing macromolecules and is commonly used in biology and biomedicine to measure the mass of biological molecules. One prominent example for TOF-MS is the matrix-assisted laser desorption and ionization (MALDI) time-of-flight mass spectrometer. In a MALDI-TOF system the sample molecules are embedded in a light-absorbing matrix and are vaporized and ionized by a short laser pulse and accelerated by a high voltage (~30 kV). The molecular ions then fly ballistically through an evacuated flight tube of given length and their arrival at the other end is registered by a detector. Measuring the flight time of the molecular ions between the laser pulse (start signal) and the detector signal (stop signal) allows one to calculate the mass of the ions (more precisely, the mass/charge ratio).

Conventional mass spectrometers for biomolecules use microchannel plates (MCPs) to measure the arrival times of molecular ions. An ion impacting onto the front metal surface of the MCP can produce one or several secondary electrons which are then multiplied in the MCP and give rise to the signal, a short charge pulse. For large molecules (M>50 kDa) the velocity attained in a typical mass spectrometer is too slow to produce secondary electrons efficiently on the surface of the MCP. Thus, the detection efficiency of an MCP drops dramatically for large masses in a typical TOF mass spectrometry system. The utility of existing MALDI-TOF-MS for studying large biomolecules is therefore severely limited by the lack of detector sensitivity at high masses. Thus, there has been a need for dramatically improving the sensitivity and the mass range accessible by MALDI-TOF-MS.

It has been found that the use of cryogenic detectors in TOF-MS systems solves the sensitivity problems associated with MCP detectors. Cryogenic detectors are a new class of very sensitive, energy-resolving, low-threshold particle detectors which respond to ion energy and do not rely on secondary electron production.

Cryogenic detectors are currently being developed for a variety of applications in particle and nuclear physics, such as x-ray spectroscopy, optical spectroscopy, and searches for dark matter in the form of weakly interacting massive particles (WIMPs).

Cryogenic detectors rely on measuring low-energy solid-state excitations as part of their detection mechanism, and therefore must be operated at temperatures typically below 2 K to avoid excess thermal excitations. The energy of these excitations, typically ±5 meV, is much less than the ~eV energies needed to produce secondary electrons or electronic excitations in conventional ionization detectors, such as the MCP. Thus, a relatively large number of excitations is created for given energy deposition which allows the energy to be measured with smaller statistical error and thus much greater precision. This low excitation energy makes cryogenic detectors much more sensitive to weakly ionizing, slow moving particles than ionization detectors. Cryogenic detectors are therefore ideal for measuring the mass of large species, such as massive biomolecules, in time of flight mass spectrometry.

Another advantage of cryogenic detectors is that they are energy-resolving detectors, i.e., the measured pulse height is roughly proportional to the total ion energy. This can be exploited for TOF mass spectrometry in several ways. First, the energy resolution can be used to distinguish ions with different charge states. A doubly-charged ion carries twice the kinetic energy and will result in a pulse whose height is twice as large as that of a singly-charged ion accelerated by the same voltage. Charge discrimination is very valuable when ion launching techniques, such as electrospray, are used which create a large range of charge states making analysis with a conventional detector difficult. Charge discrimination is also useful for MALDI techniques, which generally produce a non-negligible fraction of multiply-charged ions, too. Second, good energy resolution may also allow details of the launching process to be studied by measuring the kinetic energy deficit or the internal energy large ions acquire during the launching and accelerating process in a TOF-MS system. Good energy resolution also may help to reveal where and how some of the macromolecules fragment in the TOF-MS system and thus assist in developing better TOF-MS systems.

There are various types of cryogenic detectors which offer both, high sensitivity to large molecules and good energy resolution, which can be used for charge discrimination. These include detectors based on the following sensors; superconductor-insulator-superconductor (SIS) tunnel junctions (often just called superconducting tunnel junctions or STJs), normal conductor-insulator-superconductor (NIS) tunnel junctions and transition edge sensor (TES). These sensors can be used as detectors just by themselves by directly bombarding them with particles or photons. To increase area and efficiency these sensors can also be coupled to a variety of larger particle or photon absorbers such as superconducting or normal conducting metal films, superconducting crystals or dielectric crystals. In addition, several sensors or sensor/absorber combinations can be grouped into arrays to increase the effective detector area.

SIS tunnel junctions consist of two layers of superconductors (S) separated by a thin insulating barrier (I), for example, Nb-$Al_2O_3$-Nb. When the tunnel junction is cooled to well below the critical temperature of the superconducting layers nearly all the conduction electrons form weakly bound pairs, called Cooper pairs. The binding energy of a Cooper pair is $2\Delta$where $\Delta$ is the superconducting gap and typically of the order of 1 meV or less. When a particle, such as a MALDI ion strikes the surface of an SIS tunnel junction, the kinetic energy of the ion creates non-thermal phonons (quantized crystal lattice vibrations) which are then absorbed by the superconducting films. In this process many Cooper pairs are broken up. As a result, so-called quasiparticle excitations are created which can then quantum-mechanically tunnel through the tunnel barrier producing a measurable current pulse when a small bias voltage of the order of 1 mV is applied to the junction. Since only a few meV are required to break a Cooper pair the kinetic energy of a MALDI ion, typically tens of keV, produces millions of quasiparticles. The magnitude of the tunneling current pulse is proportional to the number of quasiparticles produced which in turn corresponds to the amount of energy deposited into the detector by an impacting ion. The duration of the current pulse is given by the quasiparticle lifetime which is typically a few microseconds. The pulse onset corresponds to the MALDI ion arrival time and can be measured to ~100 ns which is sufficient for most large-molecule MS applications. This time resolution may be improved in future versions of these STJ detectors optimized for MS applications.

Variations of this simple SIS tunnel junction are SIS' tunnel junctions and SIS or SIS' tunnel junctions with superconducting trapping layers. In an SIS' tunnel junction (also sometimes called a heterojunction) the two superconducting layers are made of materials with different superconducting energy gaps. Such junctions are used to study the behavior of tunnel junctions and for some special applications. The signal from an SIS or SIS' junction can be increased by adding a so-called superconducting trapping layer on one or both sides of the tunnel barrier. These trapping layers are made of superconductor with lower energy gap and serve to concentrate quasiparticle excitations near the tunnel barrier thus increasing the signal. One example of such a device would be a Nb-Al-$Al_2O_3$-Al-Nb junction. Typically STJs with trapping layers have larger signal and better energy resolution, but have to be operated at a lower temperature to avoid thermal quasiparticle excitation in the lower-gap trapping layers.

NIS tunnel junctions consist of one layer of normal conducting metal (N) and one layer of superconductor (S) separated by a thin insulating barrier (I), for example, Cu-$Al_2O_3$-Al or Ag-$Al_2O_3$-Al. Under proper bias conditions the tunneling current in such a device is a very sensitive function of the temperature of the normal metal electrode. Therefore, NIS tunnel junctions can be used as very sensitive thermometers. When a particle, such as a MALDI ion strikes an NIS tunnel junction or a normal metal absorber attached to an NIS junction the kinetic energy of the ion is ultimately converted to heat which briefly warms the NIS junction. The temperature rise is proportional to the deposited energy and can be measured as a tunneling current pulse.

Transition edge sensors (TESs) are another type of sensitive thermometers which can be used in the same way as NIS junctions to measure the impact of particles in a TOF-MS system. A TES consists of a thin film of superconductor which is operated in its transition from the superconducting to normal conducting state. In this transition region the electrical resistance of TES is a very sensitive function of temperature. The short temperature rise caused by the impact of a particle onto an TES or an absorber connected to a TES briefly changes the resistance of the TES and can be measured with the proper readout circuit as a current or a voltage pulse. TES sensors can be made either of pure superconductors such as Nb, Ta, Al, Mo, Zn, Cd, Ti, Ir and Hf or of bilayers or multilayers of normal metals and superconducting metals, e.g. Ag/Al, Cu/Al or Au/Ir. The addition of a normal metal film to a superconducting film results in the lowering of the superconducting transition temperature by means of the proximity effect. This is often done to lower the operating temperature and thus to increase the sensitivity of a TES based detector.

NIS and TES sensors, often also called "hot-electron microcalorimeters", are true thermal sensors measuring the heat ultimately generated in the detector by a molecule's impact. They are relatively slow (~30–300 $\mu$s time constants) and have to be operated at very low temperature (~0.1 K or below) for best performance. As a potential advantage NIS or TES based detectors can cover an even better energy resolution than SIS tunnel junction based detectors. In contrast to NIS or TES based sensors, SIS tunnel junctions, or "STJ microcalorimeters", measure a non-thermal quasiparticle signal created by non-thermal phonons immediately after a molecule's impact before the deposited energy thermalizes and is converted to heat. Therefore, SIS tunnel junctions offer a higher speed and can be operated at a somewhat higher temperature (~1 K, depending on the superconducting material) than NIS or TES based detectors. The higher the operating temperature of a cryogenic detector the easier is its implementation into a time-of-flight system and the more room temperature thermal radiation the detector can be exposed to. Very small tin (Sn) STJ sensors have been utilized in a TOF system before this work. Compared to the Nb STJ sensors used in this work Sn STJ sensors require a relatively low operating temperature of 0.3 K, close to the typical operating temperature of NIS or TES sensors and thus already severely limiting the detector area which can be exposed to room temperature operation. Whether NIS tunnel junctions, TES sensors or SIS tunnel junctions are optimal and should be used for a given application will be determined by the actual requirements of a measurement.

For all types of detectors discussed here the signal can be increased by placing the detectors onto very thin substrates or membranes, made of a mechanically strong insulator, such as $Si_3N_4$. When the detector is located on a membrane the phonons created by a macromolecule's impact are prevented from escaping from the vicinity of the detector. This increases the fraction of phonons absorbed in the metal layers of the detector and thus the measured signal height.

For all three types of the cryogenic detectors discussed here the detector area of existing prototypes is small, about 0.2–0.5 mm on a side, which is not ideal for MS applications. Increasing the size of an individual detector is possible, but usually results in a degradation of sensitivity, energy resolution and speed. To increase the effective area many individual detector elements can be grouped into larger arrays in which each individual detector element is read out by its own electronic channel. Since most cryogenic detectors can be fabricated by photolithographic techniques fabricating large arrays of detectors is almost as simple as fabricating a single detector.

Based on the recognition of the capabilities of cryogenic detectors for TOF-MS applications, the present invention is directed to the use of normal conductor-insulator-superconductor (NIS) tunnel junctions, transition edge sensors (TES), and superconducting tunnel junction (STJ) detectors in TOF-MS systems, and more particularly to a cryogenically-cooled Nb-$Al_2O_3$-Nb STJ detector for TOF-MS systems. Such a Nb-$Al_2O_3$-Nb detector has experimentally demonstrated the high detection efficiency of cryogenic detectors for high-mass biomolecular ions when used as a detector in a MALDI time-of-flight mass spectrometer. It can be operated at 1.3 K in a room temperature TOF-MS for large-biomolecules and cycled nearly infinitely. Thus, it has been demonstrated that by the use of the superior sensitivity of cryogenic detectors, slow-moving massive molecules can be effectively detected, that the energy resolution offered by such detectors can be utilized to measure and discriminate the charge of the ions and to study ion fragmentation. In addition to biomolecular ions, future applications may include other particles such as polymers, aerosol droplets and viruses.

SUMMARY OF THE INVENTION

It is an object of the present invention to provide a cryogenic particle detector for use in time-of-flight mass spectrometers.

It is a further object of the invention to utilize the charge discriminating capabilities of cryogenic particle detectors in time-of-flight mass spectrometers.

It is a further object of the invention to use the superior sensitivity of cryogenic detectors for slow-moving, massive molecules and also profit from the energy resolutions such detectors offer by using it to measure and discriminate the charges of the ions, to measure initial velocity and internal energy of the ions, and to study ion fragmentation.

A further object of the invention is to provide ultra-high-mass mass spectrometry with charge discrimination utilizing electrospray ionization for creating multiple charged ions.

A further object of the invention is to provide ultra-high-mass mass spectrometry with charge discrimination using a cryogenic detector from the group utilizing superconductor-insulator-superconductor (SIS) tunnel junctions, normal conductor-insulator-superconductor (NIS) tunnel junctions, and transition edge sensors (TES).

A further object of the invention is to provide ultra-high-mass mass spectrometry with charge discrimination using a superconducting tunnel junction detector.

Another object of the invention is to provide an improved superconducting tunnel junction (STJ) detector.

Another object is to provide an STJ detector which provides a 2–3 orders of magnitude higher detection efficiency per unit area for the STJ detector compared to an MCP detector.

Another object of the invention is to provide a MALDI time-of-flight mass spectrometer with an STJ detector.

Another object of the invention is to provide a cryogenically-cooled Nb-$Al_2O_3$-Nb STJ detector for TOF-MS.

Another object of the invention is to provide a time-of-flight mass spectrometer will a multiple-element STJ sensor array for TOF-MS.

Other objects and advantages of the present invention will become apparent from the following description and accompanying drawings. Basically, the invention involves ultra-high-mass mass spectrometry with charge discrimination using a cryogenic detector, such as a superconducting tunnel junction (STJ) detector. Experimental verification has been carried out using a cryogenically-cooled Nb-$Al_2O_3$-Nb STJ detector. It has been determined experimentally that by using the cryogenically-cooled STJ detector slow-moving, massive molecules can be effectively detected in a time-of-flight mass spectrometer (TOF-MS), such as the MALDI time-of-flight system. In addition to the high sensitivity of the STJ detector which enables its use for slow-moving massive molecules, the energy resolution capability of the STJ detector also enables its use to measure and discriminate the charges of the ions. The energy resolving capability of this detector may also be used to study fragmentation of macromolecules as well as to study details of the ion launching process and the kinetic energy deficit and the internal energy large ions acquired during the launching and accelerating process in a TOF-MS.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The present invention is directed to ultra-high-mass mass spectrometry with charge discrimination using cryogenic detectors, such as a superconducting tunnel junction (STJ) detector. The invention broadly involves a new use for cryogenic particle detectors as ion detectors with charge discriminating capabilities in high-mass time-of-flight mass spectrometers (TOF-MS). The invention utilizes the superior sensitivity of cryogenic detectors for slow-moving, massive molecules and also the energy resolution such detectors offer by using it to measure and discriminate the charges of the ions. The energy resolving capability may also be used to study fragmentation of large ions and details of the ion launching process and the kinetic energy deficit and the internal energy large ions acquired during the launching and accelerating process in a TOF-MS. While cryogenic detectors utilizing SIS tunnel junctions, NIS tunnel junctions, and transition edge sensors (TES) may be utilized, the following description is directed to the use of SIS tunnel junctions (commonly known as superconducting tunnel junctions or STJs). Using a cryogenically-cooled Nb-$Al_2O_3$-Nb embodiment of an STJ detector cooled to 1.3 K in a MALDI time-of-flight mass spectrometer, which was also equipped with a conventional MCP detector, and using a time-of-flight spectrum of human albumin, a comparison of the efficiency of the STJ detector with the efficiency of the MCP detector revealed that the STJ detector is about two-three orders of magnitude higher in detection efficiency per unit area than the MCP detector. For details of the experimental comparison of the STJ detector see the above-referenced Provisional application Ser. No. 60/032,527. For higher molecular mass one can expect an even higher relative efficiency for the cryogenically-cooled STJ detectors since the ionization-based (MCP) detectors show a rapid decline in detection efficiency as ion mass increases. These preliminary experiments also showed the capability of the STJ detector to discriminate singly and doubly charged albumin ions and immunoglobulin ions.

Figure 1:
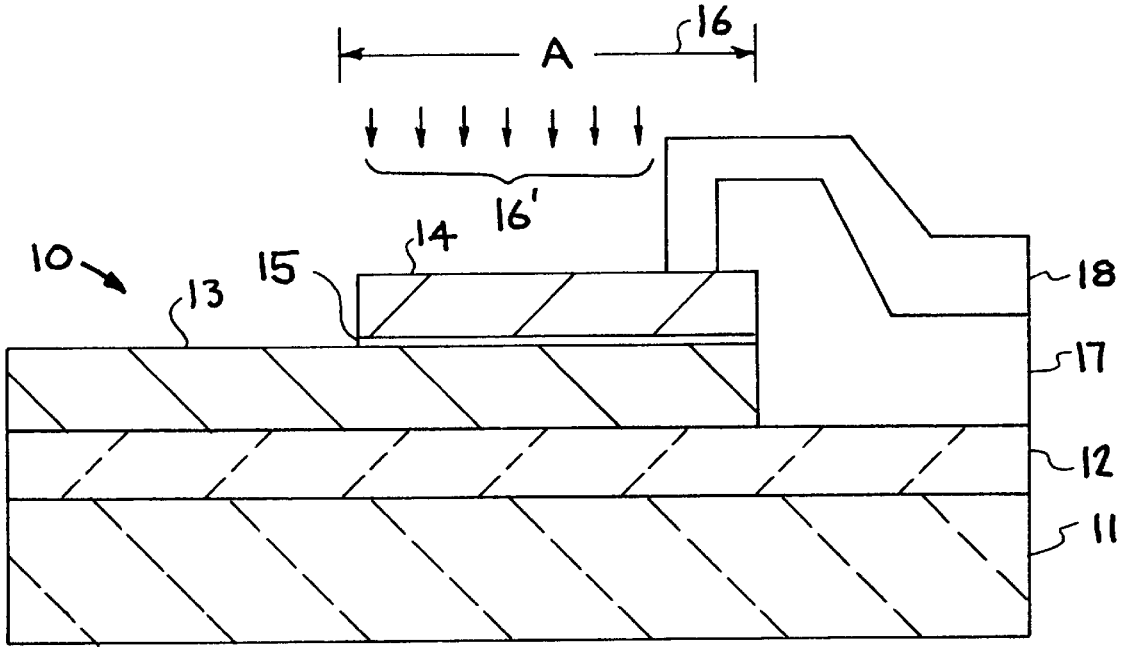
FIG. 1 is a cross-sectional view of an embodiment of a superconducting tunnel junction (STJ) sensor made in accordance with the present invention.
Figure 3:
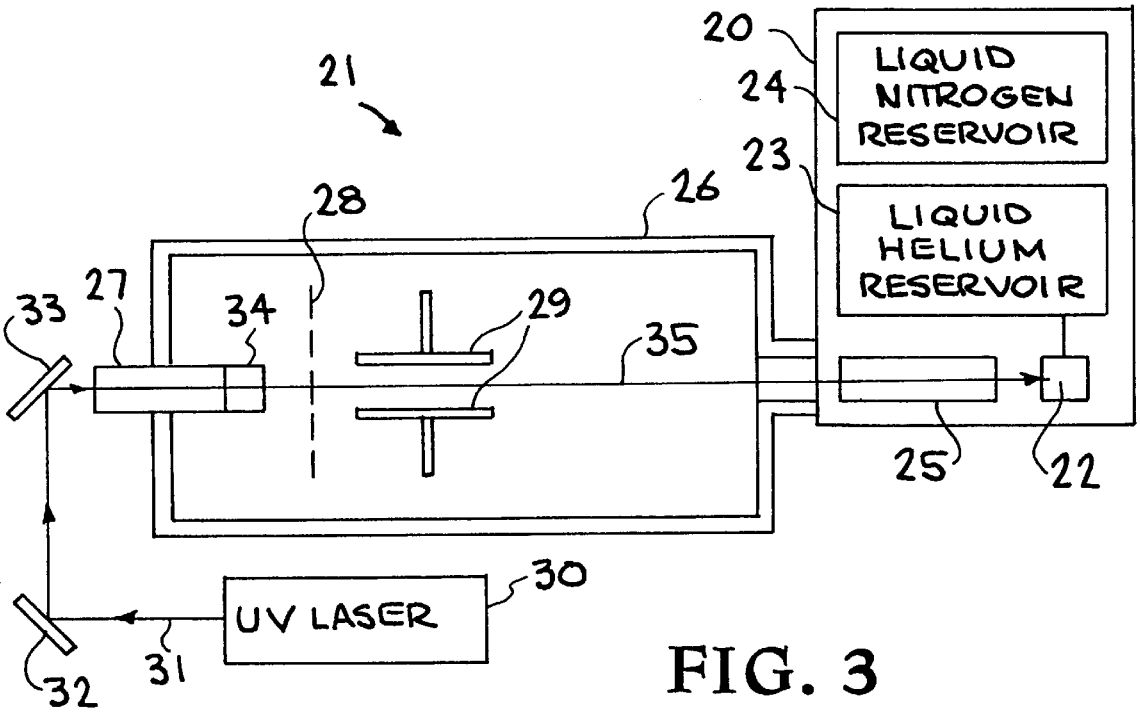
FIG. 3 schematically illustrates an experimental setup utilizing a MALDI time-of-flight system in conjunction with the ultra-high-mass biomolecule detector assembly of the invention.
Figure 2:
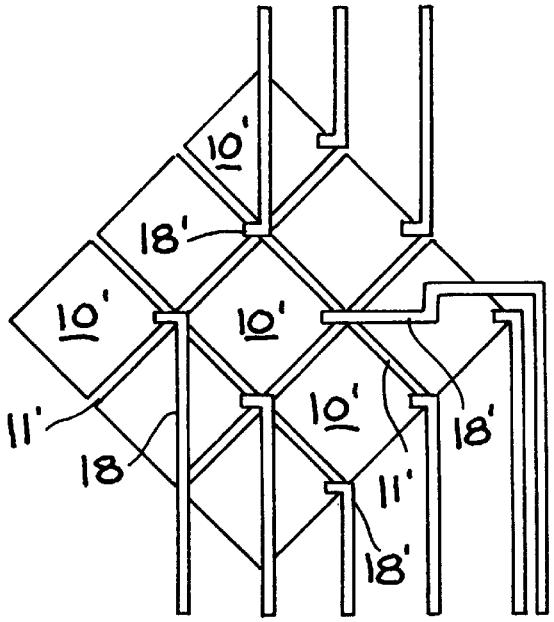
FIG. 2 schematically illustrates an embodiment of a multiple STJ sensor array.

Referring now to the drawings, FIG. 1 illustrates in cross-section an embodiment of an STJ sensor of the invention, which solves the sensitivity associated with MCP detectors, the complete ultra-high-mass biomolecule detector assembly coupled to a TOF-MS system being illustrated in FIG. 3. This cryogenic detector responds to ion energy and does not rely on secondary electron production, and therefore detects large molecular ions with a velocity-independent efficiency approaching 100%. The compact cryogenic detector assembly, can be easily mounted to a TOF-MS system, such as the MALDI time-of-flight system as shown in FIG. 3 or any other TOF-MS system including electrospray systems, Matrix Assisted Laser Desorption/Field Ionization (MALDFI) systems, orthogonal electrospray systems, and TOF system utilizing electrical or magnetic sectors. Although this detector assembly is based on superconducting Josephson tunnel junction (STJ) sensors operating at temperatures below 2 K, it is easy to use and is priced comparable to conventional detectors. The detector assembly offers a time resolution of about 100 ns which is sufficient for large-molecule MS applications. In present versions, the size of a sensor element is about 0.2 mm on a side. However, the effective or sensitive detector area can be easily increased by combining several sensor elements into larger arrays, as shown in FIG. 2. The cryogenic detectors rely on measuring low-energy solid-state excitation, and the energy of these excitations, typically ≅few meV, is 1000 times smaller than the energies needed to produce secondary electrons or electronic excitations in conventional ionization detectors. The STJ sensor of this invention operates at 1.3 K in a room temperature TOF-MS for large biomolecules.

A cross-sectional view of an embodiment of a STJ sensor is shown in FIG. 1. The sensor is fabricated by thin film deposition techniques and basically consists of two thin niobium (Nb) films separated by a thin insulating barrier (tunnel barrier) of $Al_2O_3$, for example. In operation, the sensor is cooled to a temperature of about 1.3 K which is far below the superconducting transition temperature of the niobium films of 9.2 K. When macromolecules impact on the surface of the detector their energy is absorbed in the niobium films and converted to non-thermal excitations. Simply speaking, some of the superconductivity in the niobium films is broken. This results in the signal, a current pulse through the tunnel barrier. The amplitude of the tunneling current pulse is proportional to the number of excitations and therefore the total energy absorbed by the Nb film. In the present version, illustrated in FIG. 1, the sensor can register the arrival time of an ion with a precision of about 100 ns, which is more than sufficient for measuring large biomolecules.

As shown in FIG. 1, the embodiment of the STJ sensor or detector indicated generally at 10 is deposited on a 0.5 mm thick silicon (Si) substrate 11 via an insulation layer 12 of 200 nm thick $SiO_2$, and consists of a 260 nm thick niobium (Nb) base electrode 13 and a 100 nm Nb counter electrode 14 separated by a thin (~20Å) $Al_2O_3$ tunnel barrier 15. These Nb films or electrodes 13 and 14 are superconductors below 9.2 K. In this embodiment the sensitive area, A, indicated at 16 has a length of 200 $\mu$m and a detection area of 0.04 $mm^2$, and in which incident particles, indicated by arrows 16' are directed onto niobium layer 14. In this embodiment, a layer 17 of insulation, such as $SiO_2$, is deposited at one side of Nb films 13 and 14, and an Nb contact or lead 18 is deposited on insulator layer 17 and in contact with Nb electrode 13, and by which the signal (current pulse) through the tunnel barrier 15 is transmitted to a point of use.

By way of example, the substrate 11 can also be composed of $Si_3N_4$, sapphire, silicon oxide, diamond, or $MgO_2$, or other substrate materials commonly used in thin-film fabrication, with a thickness of 100 nm to 10 mm, with the insulator layers 12 and 17 composed of $Al_2O_3$, SiO, $SiO_2$, or $TiO_2$, with a thickness of 50 nm to 1000 nm, the electrodes 13 and 14 and contact lead 18 may also be composed of any of the materials from the group of Hf, Re, Cd, Zn, Mo, Al, Pb, Ta, Al, Ti, Sn, NbN, NbTi, or V, with the tunnel barrier film 15 also composed of the oxides of Ti, Mf, Zr, Ta, Sn and other insulating materials. The electrode 13 may range in thickness from 20 nm to 2000 nm, while electrode 14 may have a thickness range of 20 nm to 2000 nm, with the tunnel barrier having a thickness of 0.5 nm to 5 nm. The sensitive area 16 may be increased to a range of 200×200 $\mu m^2$ to 1000 ×1000 $\mu m^2$.

The embodiment of the single STJ sensor 10 of FIG. 1 measures 0.2 mm on a side, and thus is not generally as large as the diameter of a focused ion beam in a time-of-flight mass spectrometer, typically a few millimeters. To further increase the efficiency of a TOF-MS system equipped with an ultra-high-mass biomolecular detector, as shown in FIG. 3, the detector will contain larger single-element STJ sensors, or any array of STJ sensors. One example for a sensor array measuring 0.6 mm on a side is shown in FIG. 2, wherein 9 STJ sensors, as shown in FIG. 1, are combined for covering a sensitive area of 0.6 mm×0.6 mm. As shown, nine (9) individual sensors 10' are deposited on a common substrate 11' with contacts or leads 18' extending therefrom to a point of use.

A typical configuration of the ultra-high-mass biomolecular detector assembly of the present invention in a TOF mass spectrometer is illustrated in FIG. 3, where the detector assembly indicated generally at 20 is mounted to a matrix-assisted laser desorption and ionization (MALDI) time-of-flight (TOF) system generally indicated at 21. The detector assembly 20 is basically composed of an STJ Sensor 22, such as shown in FIG. 1 or 2, which is cryogenically cooled by a liquid helium reservoir 23 and a liquid nitrogen reservoir 24, and provided with an infrared (IR) blocking tube 25. The MALDI-TOF system 21 comprises an evacuated flight tube 26, within which is mounted a sample holder 27, an accelerator grid 28 and deflection plates 29, with a ultra-violet (UV) laser 30 directing a beam or pulses of energy 31 onto sample holder 27 via mirrors 32 and 33. A sample 34 is positioned so as to be ionized by the laser beam 31 via a transparent sample holder 27, such as a quartz rod. In the process of MALDI, the laser 30 emits very short light pulses 31 which desorbs and ionizes molecular components from the sample 34, embedded in a light-sensitive matrix. The resulting ions are accelerated by a high voltage on accelerator grid 28 and propagate ballistically through the flight tube 26 as indicated by the dash line 35. The deflection plates 29 in the flight tube 26 help to focus the ions onto the STJ sensor 22 of detector assembly 20. Measuring the ion flight time, $\Delta t$, through the evacuated flight tube 26 from launch (end of sample holder 27) to arrival at the STJ sensor 22 provides a way to calculate the ion mass, M, accelerated through the flight tube 26. Neglecting the short time and distance for the initial acceleration (from sample holder to accelerator grid), $M=2qU(\Delta t/L)^2$, where L is the length of the flight path of a molecular ion of charge q accelerated by a voltage U. In a typical experimental setup, the length of the flight tube is 1–2 m and the acceleration voltage is 20–30 kV. This results in typical ion flight times of several 100 $\mu$s for biomolecular ions of several 100,000 amu mass. Larger molecules travel correspondingly slower. Other TOF-MS systems which profit from the sensitivity and the charge discrimination provided by cryogenic detectors include systems based on electrospray, MALDFI, orthogonal electrospray, orthogonal MALDI, and systems utilizing electrical or magnetic sectors.

The ultra-high-mass biomolecular detector assembly, such as shown at 20 in FIG. 3, is light (<20 lbs.) and robust, and can be mounted to any TOF-MS system. The embodiment of the detector assembly illustrated at 20 in FIG. 3 is cooled by liquid helium. The operating temperature of 1.3 K may be achieved by pumping on the liquid helium with a mechanical pump. In the future such detectors may be cooled to their operating temperature by liquid nitrogen, or by means of a closed-cycle refrigerator, possibly combined with an adiabatic demagnetization refrigerator (ADR), a continuous-flow cryostat, a $^3$He cryostat, or a $^3$He/$^4$He dilution refrigerator.

Figure 5:
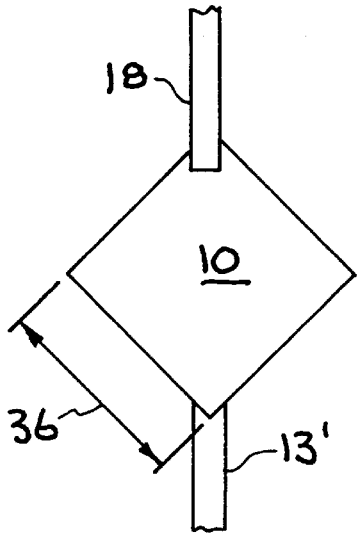
FIG. 5 is a top view of the STJ sensor of FIG. 4.
Figure 4:
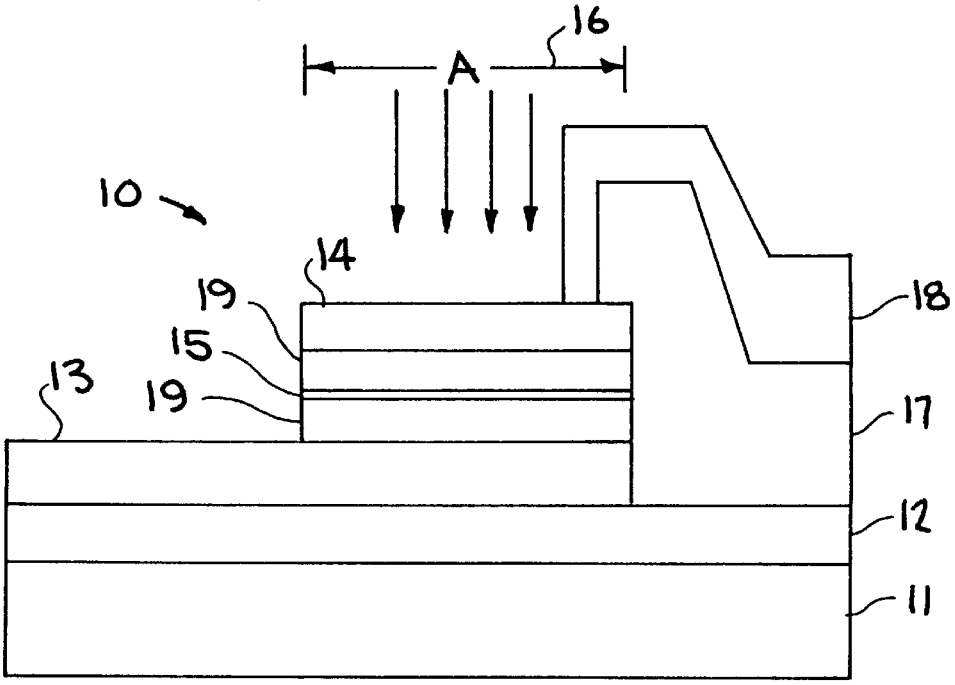
FIG. 4 is a cross-sectional view of another embodiment of a superconducting tunnel junction (STJ) sensor of the invention.

The embodiment of FIG. 4 differs from that of FIG. 1 primarily in the addition of trapping layers on each side of the tunnel barrier which help to increase the signal. Components corresponding to those of FIG. 1 are given corresponding reference numerals. As shown in FIG. 4, trapping layers 19 are formed on each side of tunnel barrier 15 and between tunnel barrier 15 and niobium layers 13 and 14. The FIG. 4 sensor, for example, consists of a 265 nm thick Nb base layer 13 and a 165 nm thick Nb counter electrode 14 separated by a thin (~20 Å) $Al_2O_3$ tunnel barrier 15, with Al trapping layers 19 on each side of the tunnel barrier 15 having a thickness of 35 to 200 nm. The sensor of FIG. 4, as shown in FIG. 5 is, as indicated by arrow 36, 200 $\mu$m by 200 $\mu$m and diamond-shaped, with sizes ranging from 20×20 $\mu m^2$ to 200×200 $\mu m^2$. As seen in FIG. 5, the electrode 14 of sensor 10 is connected to counter electrode lead 18, and a base electrode lead 13' which is connected to base electrode 13 of sensor 10.

It has thus been shown that the ultra-high-mass biomolecular detector, utilizing cryogenic detectors, such as one or more STJ sensors solves the sensitivity problems associated with MCP detectors. This cryogenic detector responds to ion energy and does not rely on secondary electron production, and therefore detects large molecular ions with a velocity-independent efficiency approaching 100%. The STJ sensors operate at 1.3 K in a room temperature TOF-MS for large biomolecules. The improved sensitivity provided by this detector significantly enhances the capabilities of time-of-flight mass spectrometry, an important analysis tool in biomedical research. This advanced detector technology will lead to significant expansion of biomedical research horizons and commercial applications of TOF-MS. The TOF-MS with the cryogenic, ultra-high-mass biomolecular detector combines the advantages of competing methods, in that it is fast, is sensitive for very large molecular masses, has good mass resolution, and is affordable.

Applications for the detector assembly using one or more STJ sensors, for example, include mass spectrometry of high-mass biomolecules such as proteins, DNA fragments or biotoxins; mass spectrometry and/or weighing of entire viruses, bacteria, other micro-organisms, and other particles, such as aerosol droplets, dust particles, colloidal particles, polymers; DNA sequencing; weighing of particles in the mass range of femtograms to picograms, as well as DNA and protein identification as part of disease diagnostic procedures.

While particular embodiments of the invention, along with materials, parameters, etc., have been illustrated and or described such are not intended to be limiting. Modifications and changes may become apparent to those skilled in the art, and it is intended that the invention be limited only by the scope of the appended claims.

The invention claimed is:

1. An ultra-high-mass biomolecule detector, comprising:

at least one cryogenic detector containing at least one sensor mounted on a substrate composed of a membrane having a thickness of less than 10 $\mu$m, and operated at not greater than 5 K; and cryogenic means for cooling said sensor to below 5 K.

2. The detector of claim 1, wherein said sensor is a superconducting tunnel junction sensor.

3. The detector of claim 2, wherein said sensor includes a plurality of electrodes separated by tunnel barriers, and electrical contacts connected to said electrodes.

4. The detector of claim 3, wherein said plurality of electrodes are composed of material selected from the group consisting of niobium, lead, vanadium, tantalum, tin, aluminum, molybdenum, zinc, cadmium, titanium, rhenium, hafnium, niobium nitride, and niobium titanium.

5. The detector of claim 3, wherein said tunnel barrier is composed of material selected from the group consisting of $Al_2O_3$ and oxides of Ti, Hf, Zr, Ta, Sn, and other insulating material.

6. The detector of claim 3, wherein one of said plurality of electrodes is secured to said substrate which is selected from the group consisting of silicon, silicon nitride, silicon oxide, silicon dioxide, aluminum oxide, sapphire, magnesium oxide, magnesium fluoride, diamond, and other insulating materials.

7. The detector of claim 3, wherein said plurality of electrodes are composed of niobium, and wherein said tunnel barrier is composed of $Al_2O_3$.

8. The detector of claim 7, wherein said substrate is composed of silicon, with an insulator layer of $SiO_2$, therebetween.

9. The detector of claim 7, wherein said sensor additionally includes a niobium contact secured to one of said electrodes.

10. The detector of claim 1, wherein said cryogenic cooling means is composed of at least one of the group consisting of liquid helium, liquid nitrogen, a closed-cycle refrigerator, a continuous-flow cryostat, an adiabatic demagnetization refrigerator, a $^3$He cryostat, and a $^3$He/$^4$He dilution refrigerator.

11. The detector of claim 1, wherein a plurality of said sensors are mounted in an array.

12. The detector of claim 1, in combination with a time-of-flight mass spectrometer for detecting heavy biomolecules having a mass, M, of at least about 50,000 amu.

13. The detector of claim 12, wherein said time-of-flight mass spectrometer is selected from the group consisting of matrix-assisted laser desorption and ionization systems, electrospray systems, MALDFI systems, orthogonal electrospray systems, orthogonal MALDI systems, and systems utilizing electrical and magnetic sectors.

14. The detector of claim 1, wherein said at least one sensor is selected from the group of SIS tunnel junctions, SIS' tunnel junctions, NIS tunnel junctions, and transition edge sensors.

15. In a biomolecule detector, the improvement comprising:

a superconducting tunnel junction sensor mounted on a substrate composed of a membrane having a thickness of less than 10 $\mu$m, and consisting of a pair of niobium electrodes separated by a tunnel barrier, and an electrical lead connected to one of said electrodes.

16. The improvement of claim 15, wherein said tunnel barrier is composed of $Al_2O_3$.

17. The improvement of claim 15, wherein said sensor comprises a plurality of pairs of separated niobium electrodes, said pairs being mounted to form a sensor array.

18. The improvement of claim 15, wherein said sensor comprises an array of NIS or TES sensors.

19. The improvement of claim 15, wherein said sensor is cryogenically cooled by any of liquid helium, liquid nitrogen, a closed-cycle refrigerator, a continuous-flow cryostat, an adiabatic demagnetization refrigerator, a $^3$He cryostat and a $^3$He/$^4$He dilution refrigerator.

20. The improvement of claim 19, wherein said sensor is operated at about 1.3 K for detecting large molecules (M>50 kDa).

* * * * *